United States Patent [19]

Kertzman

[11] Patent Number: 4,774,886

[45] Date of Patent: Oct. 4, 1988

[54] RUBBER STAMP CLEANING APPARATUS

[76] Inventor: Harvey Z. Kertzman, 806 W. Roxbury Pkwy., Brookline, Mass. 02167

[21] Appl. No.: 27,314

[22] Filed: Mar. 18, 1987

[51] Int. Cl.[4] ..... B41F 35/00

[52] U.S. Cl. ..... 101/425; 101/423

[58] Field of Search ..... 101/425, 423, 424, 288, 101/291, 292, 295; 400/696, 701, 702, 702.1

[56] References Cited

U.S. PATENT DOCUMENTS

| | | | |
|---|---|---|---|
| 2,851,008 | 9/1958 | Rochester | 400/696 |
| 3,376,811 | 4/1968 | Grintz | 101/295 |
| 4,083,302 | 4/1978 | Bello et al. | 101/425 |
| 4,369,085 | 1/1983 | Hermann | 101/292 |
| 4,651,644 | 3/1987 | Kaempfe et al. | 101/423 |
| 4,671,687 | 6/1987 | Tamai | 400/696 |

*Primary Examiner*—Charles Pearson
*Assistant Examiner*—Huong Q. Pham
*Attorney, Agent, or Firm*—John M. Brandt

[57] ABSTRACT

Rubber stamp cleaning apparatus comprising a roll of self-adhesive tape rotatably mounted on a base having a platen upon which a portion of the tape is secured tacky side up. The stamp is cleaned by tamping on the tape.

1 Claim, 1 Drawing Sheet

RUBBER STAMP CLEANING APPARATUS

BACKGROUND OF THE INVENTION

1. Field of the Invention

The invention resides in the field of stationery goods and particularly relates to a device for removing lint, dirt, and excess ink from rubber stamps.

2. Description of the Prior Art

Rubber stamps are well known to lose their clarity of impression by the accumulation of foreign particles and dried ink in the recessed portions of the stamp. To the knowledge of the inventor, no means presently exist for removing such material and cleaning the stamps other than by the employment of basic hand methods such as scrubbing with a solvent.

SUMMARY OF THE INVENTION

The invention may be summarized as a device for cleaning rubber stamps utilizing the tacky side of a roll of self-adhesive tape. The apparatus consists of a base having a rotatable drum upon which is mounted the tape roll, and a platen across which a portion of the tape is secured tacky side up. Means for holding one end of the tape in contact with the platen are located on the base at the opposite end of the platen from the roll.

A serrated edge may be added after the holding means to facilitate the removal of exhausted tape.

To use the device, a length of tape is drawn from the roll and fixed in place with the smooth side against the platen and the tacky side up. The face of the stamp to be cleaned is then tamped or rocked against the tape whereupon the foreign material on the stamp surface adheres to the adhesive material on the tape and is thereby removed from the stamp.

The features and advantages of the invention will be more fully understood from the description of the preferred embodiment and drawings which follow.

DESCRIPTION OF THE PREFERRED EMBODIMENT

Figure 1:
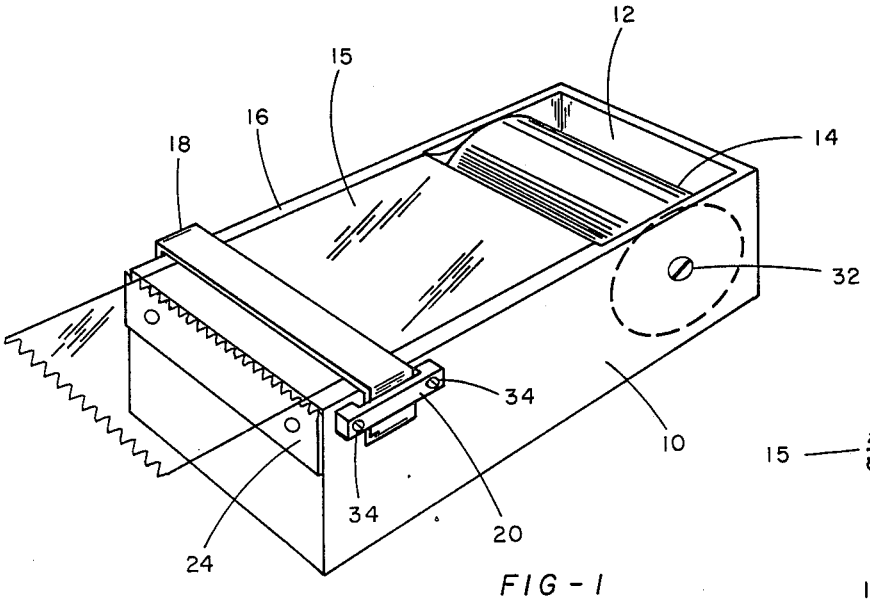
FIG. 1 is a perspective view of the preferred embodiment of the invention.

Referring first to FIG. 1, the preferred embodiment is illustrated in perspective format. Base 10 has well 12 which is sized to receive a roll 14 of self-adhesive tape 15 such as the type commonly used for sealing packages. A platen 16 which may be structurally a portion of the base configuration is located forward of the tape well. Means for securing the end of the tape against the platen consist of U-shaped plate 18 formed of, for example, spring steel and U-shaped bars 20 and (as shown in FIG. 3) 22.

A serrated edge piece 24 may optionally be attached to the end of base 10 to sever used portions of tape from the device.

Figure 2:
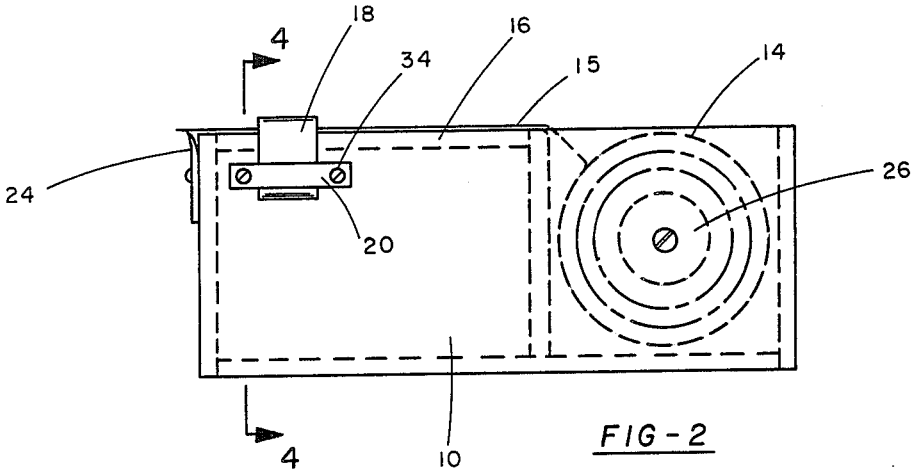
FIG. 2 is a side view of the device of FIG. 1.

FIG. 2 is a side view of FIG. 1 further illustrating the above described components and showing drum 26 upon which the tape roll is mounted. Drum 26 is rotatably mounted on axel 28 which as indicated in FIG. 3 passes through base 10 and is held at one end by expanded head 30 and removable screw cap 32.

Figure 3:
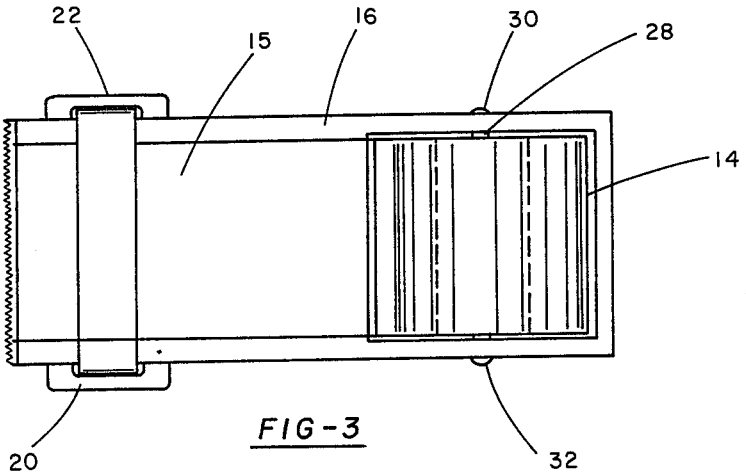
FIG. 3 is top view of the device of FIG. 1.
Figure 4:
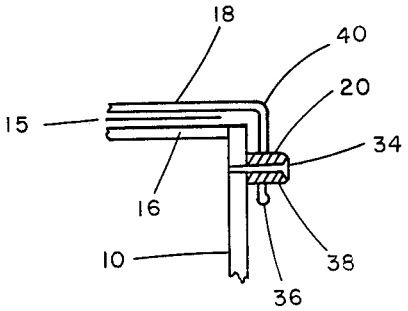
FIG. 4 is a partial cross-sectional view of FIG. 2 taken along the plane A—A.

In FIG. 3 and FIG. 4, U-shaped bars 20 and 22 are shown secured to base 10 by a plurality of screws 34. In FIG. 4 the means by which plate 18 is held against tape 15 and platen 16 is shown as retaining lip 36 which engages the underside 38 of bar 20. It will be understood that a variety of structures may be used to secure the tape 15 tautly against the platen, the opposite end being held by the adhesive contact with itself on the roll from which it is being withdrawn.

To operate the device, plate 18 is removed by first pressing side 40 toward base 10 so that retaining lip 36 clears the underside 38 of bar 20. Plate 18 is then lifted off and a length of tape 15 drawn from the roll and severed by serrated edge 24. Plate 18 is then replaced and pressed down against the up-turned tacky side of the tape. The tape is now firmly held in position against platen 16 and a subject stamp may be cleaned by contact with the tape as described above.

Variations on the above-disclosed apparatus will be obvious to those skilled in the art. Accordingly, the invention is defined by the following claims.

What is claimed is:

1. Apparatus for cleaning rubber stamp comprising in combination:

a. a base;

b. a drum rotatably mounted on said base;

c. a self-adhesive tape roll mounted on said drum, said tape having a smooth side and a tacky side;

d. a platen mounted on said base proximate to said tape roll;

e. retaining means mounted on said base for securing a portion of said tape across said platen, said retaining means comprising:

1. a pair of U-shaped bars mounted in opposed relationship on either side of said base; and 2. a U-shaped spring plate mounted in face-to-face relationship with said platen and communicating and held in place at each end with and by said U-shaped bars; and f. a serrated edge mounted forward of said platen for severing used portions of tape from said tape roll.

* * * * *